United States Patent [19]

Wesley, Sr.

[11] Patent Number: 5,014,585

[45] Date of Patent: May 14, 1991

[54] END BLOWN FLUTE WITH STANDARD KEYING

[76] Inventor: Sam Wesley, Sr., 52 Alvarado Ave., Pittsburg, Calif. 94565

[21] Appl. No.: 398,243

[22] Filed: Aug. 24, 1989

[51] Int. Cl.[5] ..... G10D 7/02

[52] U.S. Cl. ..... 84/384

[58] Field of Search ..... 84/384

[56] References Cited

U.S. PATENT DOCUMENTS

| | | | |
|---|---|---|---|
| 3,062,084 | 11/1962 | Ogilvie | 84/384 |
| 3,599,526 | 8/1971 | Sollecito et al. | 84/384 |
| 3,888,154 | 6/1975 | Wesley | 84/384 |
| 4,422,364 | 12/1983 | La Volpa | 84/384 |

FOREIGN PATENT DOCUMENTS

| | | | |
|---|---|---|---|
| 59465 | 11/1891 | Fed. Rep. of Germany | 84/384 |

*Primary Examiner*—Lawrence R. Franklin

*Attorney, Agent, or Firm*—Phillips, Moore Lempio & Finley

[57] ABSTRACT

An end-blown flute comprising a hollow tube open at both ends with an embouchure at the upper end of the tube to provide an end-blown free air-reed. The tube has at least 13 tone holes through the side wall thereof, the holes being particularly spaced from the bottom of the tube so that keys can be mounted in the tube in the same pattern as on a standard transverse flute and so that the end blown flute can be played with the same fingering system used with a standard transverse flute. The embouchure has a U-shaped opening which opening which opens into the upper end of the flute and also exposes the upper forward edge of the flute tube, making it easier for the player to get into the third register.

7 Claims, 4 Drawing Sheets

END BLOWN FLUTE WITH STANDARD KEYING

BACKGROUND OF THE INVENTION

This invention relates to true flutes based on free air-reed operation and having a body which is open at both ends, and more particularly to such a flute which is designed to be end blown and played in a vertical position.

As used in this application the word "flute" does not include any of the many types of musical instruments such as "recorders" etc., which although they do not include an actual reed, rely on a confined air passage and "fipple" for operation in the manner of a whistle. Neither does the word flute include any of the many musical instruments such as ocarinas, etc., which, although they utilize a free air-reed, comprise a body which is not tubular and does not enclose a generally cylindrical air column. Finally, as used in this application, the word flute does not include any of the musical instruments such as pan-pipes which may be generally tubular and may use a free air-reed but are closed or stopped at one end in the manner of organ pipes.

Instead, the word flute as used in this application is intended to designate musical instruments such as the so-called "transverse flute," which is widely used in the United States and Europe for entertainment, orchestral and recital purposes, and the nā or quasāba, which is used throughout the Islamic world and North Africa, respectively for similar purposes. Historically, the flute as defined herein, although acoustically simpler, is believed to be of much later origin than musical instruments of the "whistle" or "stopped" type. Furthermore, it is an historical fact that the transverse flute has undergone extensive development whereas the nā or quasāba of today is surprisingly similar to the end blown flutes shown in ancient Egyptian stele and comprises a simple straight tube about 3 feet long with from 4 to 6 holes towards the lower end held in a position slanting obliquely across the body for blowing across the end thereof.

In the 1890's an attempt was made to introduce a flute similar to the nāy or quasāba to the Western world by Carlo Tomasso Giorgi. The Giorgi flute was designed to be played in a vertical position, being provided with a free air-reed embouchure at one of its open ends, and was essentially keyless although one to four keys were added in some examples in an attempt to extend its range. (See C. T. Giorgi U.S. Pat. No. 594,735, issued Nov. 30, 1897.) At a later date a fully keyed version known as the "Giorgi-Schaffner" flute was proposed as part of universal woodwind fingering scheme intended to be competitive with the well established "Boehm" system. However, both the Giorgi flute and the Giorgi-Schaffner flute are today a collector's curiosity, as pointed out in the book entitled "The Flute" by Philip Bate first published in 1969 by Ernest Benn, London, England, and W. W. Norton Co., New York, N.Y. This fact is believed to be the result of the limited range of the Giorgi type flute, as well as playing and fingering difficulties.

A more recent end blown flute is that shown in Sam Wesley, Sr. U.S. Pat. No. 3,888,154, issued June 10, 1975. This flute has a greater range than the Giorgi or Giorgi-Schaffner flutes, and is comparable to the range of the standard traverse blown flute. However, because of the location of the tone holes, the mechanized version of the flute in the U.S. Pat. No. 3,888,154 requires an arrangement of pads and keys which differs from that of a standard transverse flute, and a fingering system also different from that used to play a transverse flute.

Although an end blown flute has significant advantages over a transverse flute in that the vertical position of playing makes it less awkward and enables greater flexibility in fingering and phrasing, the necessity for learning a different fingering system greatly inhibits a beginning flute player from choosing an end blown flute over the widely used transverse flute. Likewise, the different fingering system will deter a transverse flute player from switching to an end blown flute or from adding it as an auxiliary instrument.

It is an object of the present invention to provide an end blown flute having the range of a transverse flute and a tone hole arrangement enabling the end blown flute to be mechanized and played with the same fingering system as that used with a transverse flute.

It is a further object to provide an end blown flute with an embouchure which enables the third register to be played more easily.

SUMMARY OF THE INVENTION

In accordance with one aspect of the present invention, the flute comprises a hollow cylindrical tube about two feet long, open at both ends and having an embouchure providing a free air-reed at one of its ends. A plurality of tone holes are provided through the side wall of the flute tube for the production of all tones and semitones of at least two registers of an octave each, the holes being spaced from the embouchure such that the pad and key arrangement of a standard transverse flute may be used.

According to another aspect of the invention, the embouchure of the end blown flute has a lip plate with a downwardly curved rear portion to engage the chin and lower lip of the player and a curved top and forward portion with a generally U-shaped opening to permit the player's breath to be blown directly across the upper edge of the flute tube.

Other aspects of the invention will be apparent from the following detailed description.

BRIEF DESCRIPTION OF THE DRAWINGS

In the drawings wherein like parts ar indicated by the same reference numerals or designations throughout the same.

DESCRIPTION OF THE PREFERRED EMBODIMENT

Figure 1:
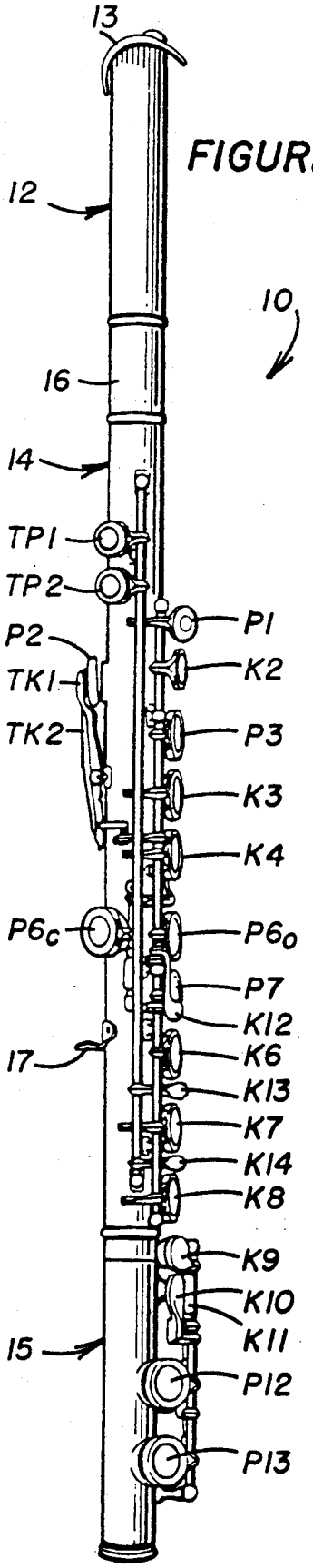
FIG. 1 is a side elevational view of a flute constructed in accordance with the present invention.

Referring now to the drawings, wherein is illustrated a preferred embodiment of the present invention, the flute 10 comprises a hollow, cylindrical tube 11 of constant internal diameter throughout its length. The flute 10 has a headjoint 12 with an embouchure 13 at its upper end, a body 14 and a footjoint 15, all telescopically assembled together. The headjoint 12 and body 14 are connected together by a slip joint 16 which enables tuning of the flute. A thumb hook 17, projecting from the rear of the body 14, enables the flute to be supported by the thumb of the lower hand of the player.

The flute may be constructed of any of the materials conventionally used in the manufacture of flutes. In embodiments of the flute as actually manufactured, the headjoint, body, footjoint, keys, padcups and the like are made of silver or silver plate, and the pads used for stopping the holes in the flute are made of a suitable resilient material.

FIGS. 6–9 show the hole location in accordance with the present invention for a flute having middle C as its lowest note, the flute having a constant internal diameter of eleven-sixteenths of an inch. The length of the flute is 24 inches from the embouchure 13 to the bottom of the footjoint 15 for a tuning of A in the range of 440–445 Hz, depending on the size of the opening the lip plate of the embouchure 13. The diameters of the trill holes TH1 and TH2 and the tone holes H1–H13 through the side wall of the flute and the distances of the trill and tone holes from the bottom of the footjoint 15 are as follows:

| Hole No. | Hole Diameter (Inches) | Distance of Hole Center from Bottom of Footjoint Embouchure (Inches) |
|---|---|---|
| TH1 | ¼ | 15⅞ |
| TH2 | ¼ | 15¼ |
| H1 | ¼ | 14 5/16 |
| H2 | 15/32 | 13⅛ |
| H3 | 15/32 | 12 5/16 |
| H4 | ½ | 11½ |
| H5 | ½ | 10 11/16 |
| H6 | ½ | 9⅜ |
| H7 | 17/32 | 8¾ |
| H8 | 17/32 | 7¾ |
| H9 | 17/32 | 6 11/16 |
| H10 | 17/32 | 5½ |
| H11 | 19/32 | 4⅛ |
| H12 | 19/32 | 2⅞ |
| H13 | 19/32 | 1⅜ |

As will be noted, there are two tone holes at 14½ inches from the embouchure, **H6*c* and H6*o*. These two holes are each one-half inch in diameter with the hole H6*c* being normally closed and hole H6*o*** being normally open.

If the flute is to be tuned to a lower pitch, for a particular embouchure, the headjoint 12 is adjusted relative to the body 14 so that the overall length of the flute is increased.

Figure 2:
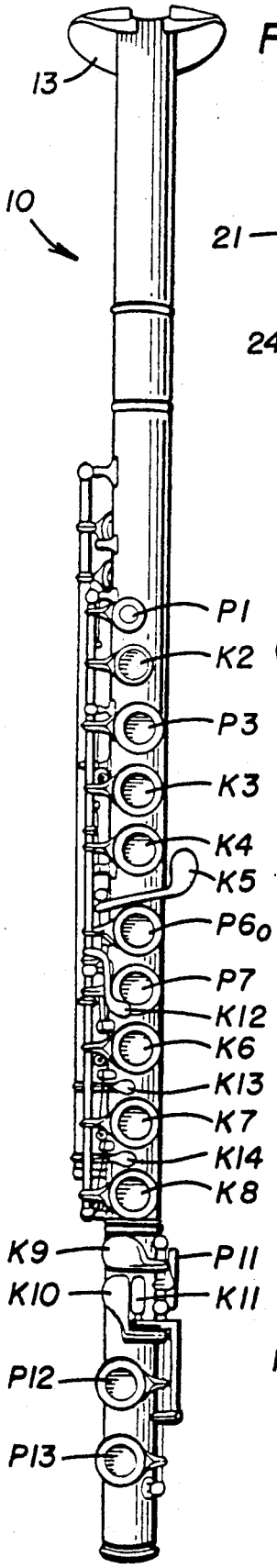
FIG. 2 is a front elevational view of the flute shown in FIG. 1.
Figure 10:
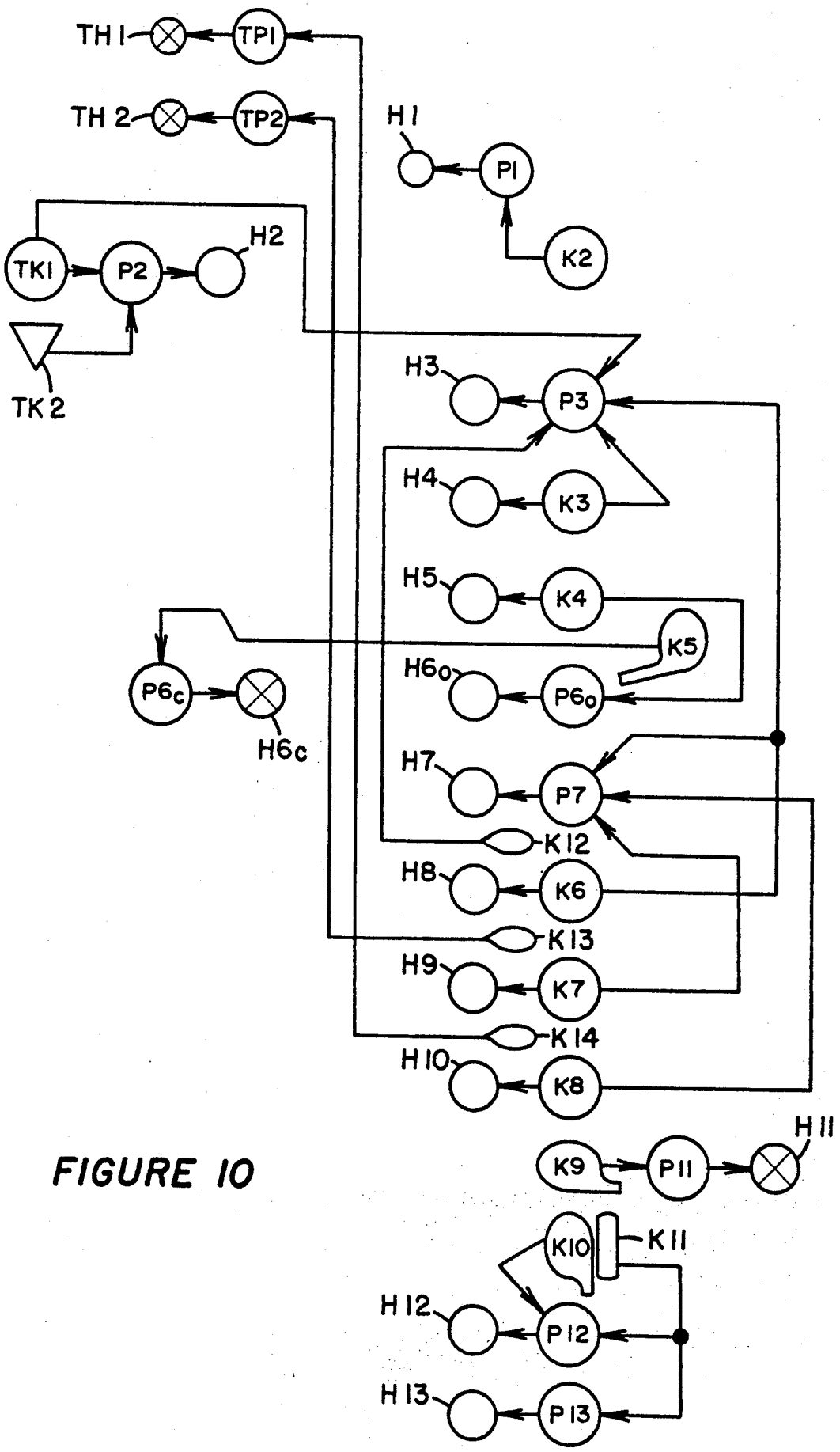
FIG. 10 is a schematic diagram of the trill and tone holes of the flute shown in FIG. 1, together with the keys and pads which selectively open and close the holes.

As shown in the elevational views of the flute, FIGS. 1 and 2, and the schematic diagram, FIG. 10, pad cups TP1 and TP2 are associated with trill holes TH1 and TH2, respectively, and pad cups P1, P2, P3, **P6*c*, P6*o*, P7, p11, p12 and P13 are associated with tone holes H1, H2, H3, H6*c*, H7, H11, H12 and H13, respectively. The finger operated keys K3, K4, K6, K7 and K8 also comprise pad cups which are directly associated with tone holes H4, H5, H8, H9 and H10**, respectively. All of these pad cups carry a conventional resilient pad (not shown) to close the hole associated therewith.

In addition, thumb-operated keys TK1 and TK2 on the back of the flute and finger operated keys K2, K5, K9, K10, K11, K12, K13 and K14 are provided on the front of the flute to selectively actuate the various key pads.

The padcups and keys are mounted on the flute tube relative to each other in the same pattern and are physically interconnected for operation in the same manner as in a standard transverse flute and thus the physical interconnecting structure shown in FIGS. 1 and 2 is not described in detail herein. Instead, FIG. 10 shows schematically which holes are opened or closed by the various manually operated keys. In FIG. 10, an "X" is shown in both of the trill holes TH1 and TH2 and the tone holes **H6*c* and H11** to indicate that the pad cups associated therewith are each spring biased to normally close these holes. The pad cups associated with all of the other tone holes are spring biased so that the tone holes are normally open.

As shown in FIG. 10, depression of thumb key TK1 will actuate pad cups P2 and P3 to close tone holes H2 and H3, while depression of thumb key TK2 will actuate only pad cup P2 to close tone hole H2. Depression of finger key K2 will cause pad cup P1 to close tone hole H1. Depression of finger key k3 will directly close tone hole H4 and will also cause pad cup P3 to close tone hole H3. Depression of any one of the keys TK1, K3, K6 or K12 will cause pad cup P3 to close tone hole H3. Depression of key K9 will cause pad cup P11 to open tone hole H11. Depression of each of the other manually operated keys will, in similar manner, cause one or more of the trill or tone holes to be opened, or closed, all as indicated in FIG. 10.

Figure 11:
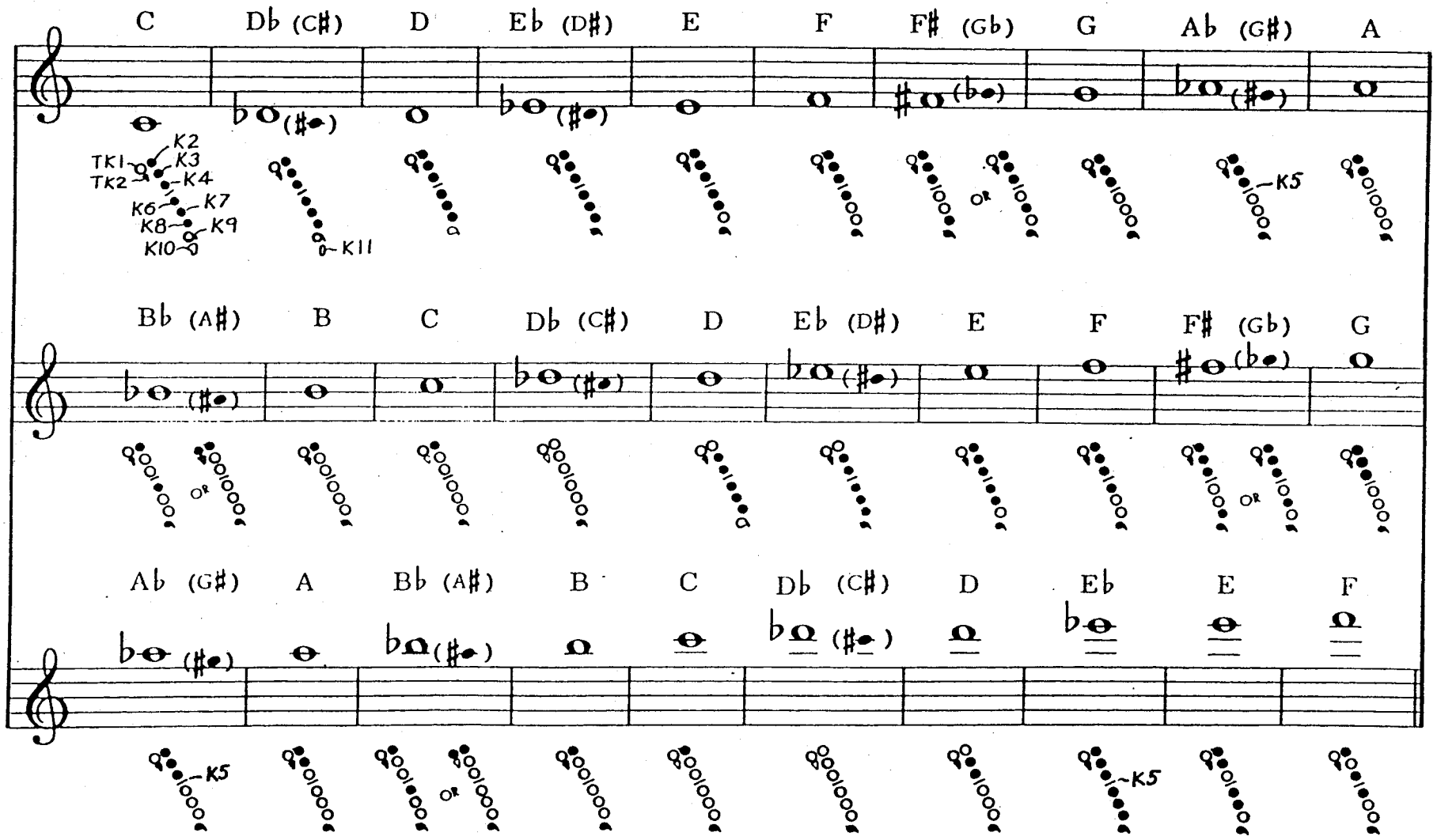
FIG. 11 is a fingering chart for the flute of FIG. 1.

FIG. 11 illustrates the fingering system for a standard transverse flute which is also applicable to the end blown flute of the present invention. In FIG. 11, a circle or symbol which is filled in represents an actuated, or depressed, key, while a circle or symbol not filled in represents an unactuated key. Thus, for middle C, the thumb key TK2 is actuated, as are also finger keys K2, K3, K4, K6, K7, K8 and K10. As may be seen from FIG. 10, with this fingering all of the tone holes in the flute will be closed. For A flat, the thumb key TK2 is actuated as are also keys K2, K3, K4, K5 and K9. Again, as may be seen from FIG. 10, tone holes H1–H5 and **H6*o* will all be closed, while tone holes H6*c* and H7–H13 will all be open. In like manner, FIGS. 10 and 11 will show which of the tone holes will be open or closed by the fingering for all of the other tones or semitones in FIG. 11**.

As may be seen from the fingering system of FIG. 11, all of the tones and semitones in the first register can be obtained by different finger combinations from middle C to E flat (D sharp) in the second octave above middle C.

The second register of the flute is obtained by tightening the lips, as is well known in the musical art, to direct the jet of air in a more downwardly direction into the flute. In the second register, all of the tones and semitones from C above middle C to D flat in the third octave above middle C can be obtained by the same fingering as in the first register. In addition, the tones and semitones from D to F in the third octave above middle C can be obtained in the second register with the fingering shown in the last four measures of the chart in FIG. 11.

The third register of the flute is achieved by a further tightening of the lips and reorientation of the jet of air, again as is well known in the art. The third register extends from the third F above middle C through C sharp of the fourth octave above middle C, using the same fingering as used to produce the same tones and semitones two octaves below in the first register.

Figure 3:
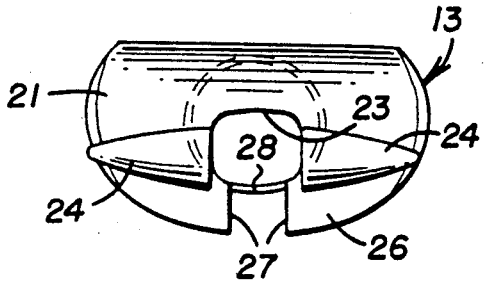
FIG. 3 is a top view of the embouchure of FIGS. 1 and 2.
Figure 4:
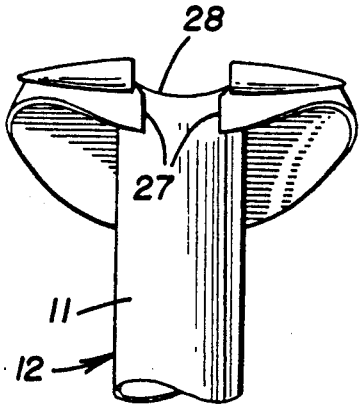
FIG. 4 is a front view of the embouchure of FIG. 3.
Figure 5:
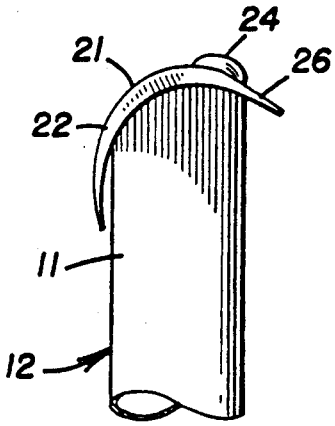
FIG. 5 is a side view of the embouchure of FIG. 3.
Figures 6, 7, 8, 9:
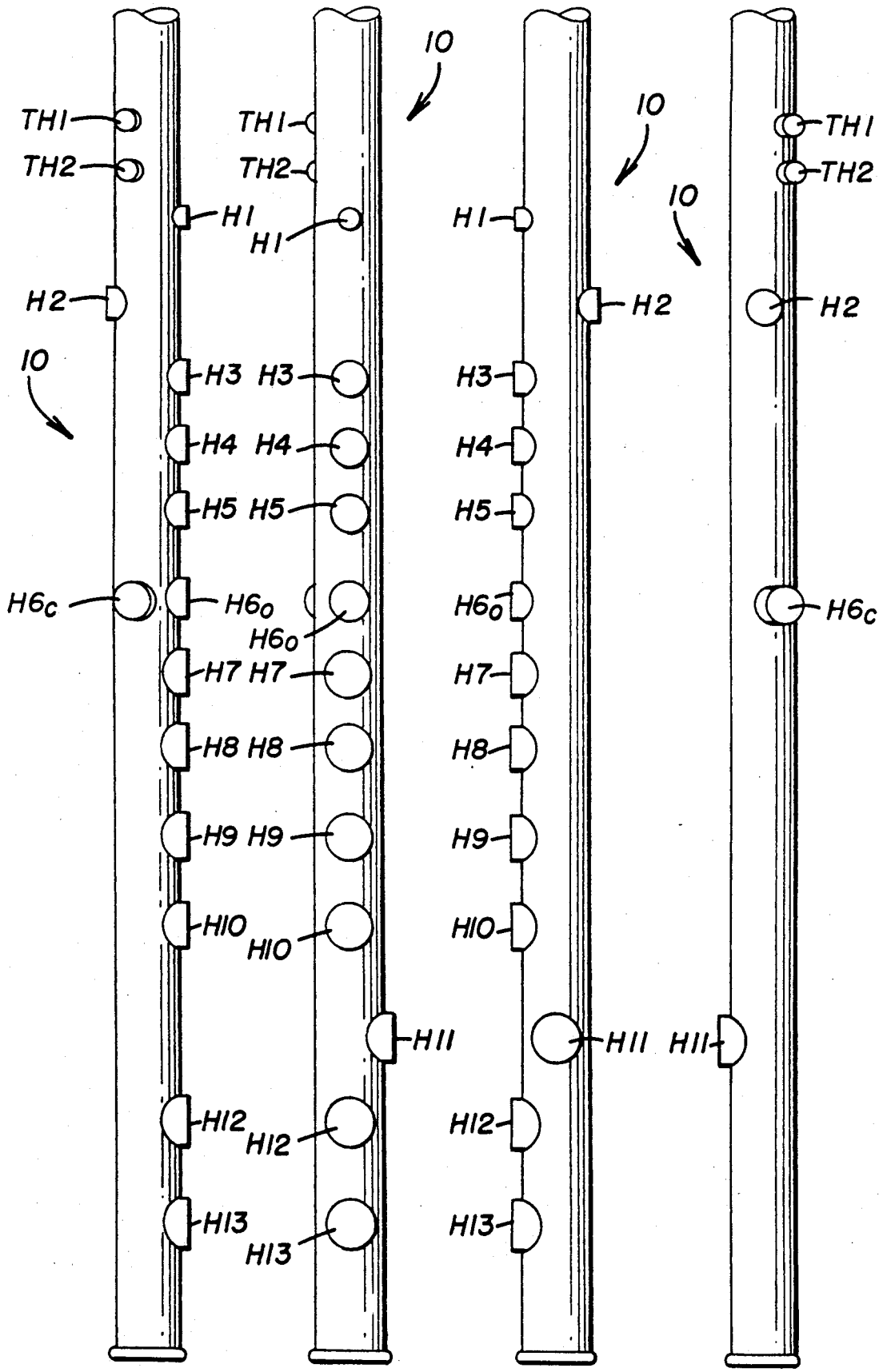
FIGS. 6 to 9 are simplified elevational views of the body of the flute shown in FIG. 1, showing the arrangement of the trill and tone holes of the flute, with FIG. 7 showing the front of the flute, FIG. 9 showing the back of the flute and FIGS. 6 and 8 showing the two sides of the flute.

As shown in FIGS. 3–5, the embouchure 13 has a lip plate 21 extending across the upper end of the tube 11 of headjoint 12, the lip plate having a downwardly curved portion 22 extending rearwardly of the tube and shaped to rest against the chin and lower lip of the player in order to facilitate the orientation of the lip plate opening 13 into the upper end of tube 11 with respect to the lips of the player. The raised guide wings 24 projecting upwardly from the lip plate 21 and extending from the opening 23 towards the sides of the lip plate also facilitates the placement of the player's lips relative to the opening 23.

The lip plate 21 also has a downwardly curved portion 26 extending forwardly of the tube 11. This lip plate portion is cut away so that the lip plate opening is substantially U-shaped, with the upper forward edge 28 of tube 11 being exposed through the opening. This enables the player's jet of air to be blown directly across the upper edge 28 of tube 11. The spacing between the opposed edges 27 of the U-shaped opening is preferably three-eighths of an inch. This particular U-head arrangement enables the third register of the flute to be obtained with greater ease than with an embouchure having a lip plate which fully surrounds the opening therethrough.

The foregoing description of the preferred embodiment has been presented for purposes of illustration and description. It is not intended to be exhaustive or to limit the invention to the precise features described, obviously many modifications and variations are possible in light of the above teaching. The embodiment was shown in order to explain most clearly the principles of the invention and a practical application thereof to enable others in the art to utilize effectively the invention in various other modifications as may be suited to the particular use contemplated. It is intended that the scope of the invention be defined by the claims appended thereto. In the claims the phrase "the same pattern as on a standard transverse flute" means the pattern of keys shown in FIGS. 1 and 2, and the terms "same fingering pattern" and "same tones" as used with a "standard transverse flute" means the fingering system and tones shown in FIG. 11.

I claim:

1. An end-blown flute, comprising:

a hollow tube open at both ends, an embouchure at one end of said tube to provide an end-blown free air-reed, said tube having at least 13 tone holes through the side wall of said tube, a plurality of manually operable keys mounted on said tube and positioned relative to each other in the same pattern as on a standard transverse flute, means operable by said keys for selectively opening or closing said tone holes to enable said flute to be played with the same fingering system as used with a standard transverse flute, said tone holes having a spacing along said tube and diameters such as to enable the same tones to be produced as those produced with the same fingering system as used with a standard transverse flute.

2. A flute as set forth in claim 1, wherein said embouchure comprises a lip plate extending across said one end of said tube, said lip plate having a downwardly curved portion extending rearwardly of said tube and shaped to rest against the chin and lower lip of a player, said lip plate having a downwardly curved portion extending forwardly of said tube, said lip plate having an opening therethrough into said one end of said tube, said portion of said lip plate extending forwardly of said tube being cut away so that said opening is substantially U-shaped with the upper forward edge of said tube being exposed through said opening.

3. A flute comprising a hollow tube open at both ends and having an embouchure at one of said ends to provide an end blow free air-reed, said tube having at least 13 tone holes through the side wall of said tube, the distance in inches from the other end of said tube to the centers of said holes, being substantially as follows:

| Tone Hole | Distance [from Embouchure] |
|---|---|
| 1 | 14 5/16 |
| 2 | 13⅛ |
| 3 | 12 5/16 |
| 4 | 11½ |
| 5 | 10 11/16 |
| 6 | 9⅝ |
| 7 | 8¾ |
| 8 | 7¾ |
| 9 | 6 11/16 |
| 10 | 5½ |
| 11 | 4⅛ |
| 12 | 2⅞ |
| 13 | 1⅝ |

a plurality of manually operable keys mounted on said tube and positioned relative to each other in the same pattern as on a standard transverse flute; and means operable by said keys for selectively opening or closing said tone holes to enable said flute to be played with the same fingering system as used with a standard transverse flute.

4. A flute as set forth in claim 3, wherein the diameter of tone hole 1 is one-quarter of an inch, wherein the diameters of tone holes 2 and 3 are each fifteen-thirtyseconds of an inch, wherein the diameters of tone holes 4, 5, and 6 are each one-half of an inch, wherein the diameters of tone holes 7, 8, 9 and 10 are each seventeen-thirtyseconds of an inch, and wherein the diameters of tone holes 11, 12 and 13 are each nineteen-thirtyseconds of an inch.

5. A flute as set forth in claim 3, wherein the length of said flute is substantially 24 inches for a tuning of A in the range of 440–445 Hz.

6. A flute as set forth in claim 3, wherein said embouchure comprises a lip plate extending across said one end of said tube, said lip plate having a downwardly curved portion extending rearwardly of said tube and shaped to rest against the chin and lower lip of a player, said lip plate having a downwardly curved portion extending forwardly of said tube, said lip plate having an opening therethrough into said one end of said tube, said portion of said lip plate extending forwardly of said tube being cut away so that said opening is substantially U-shaped with the upper forward edge of said tube being exposed through said opening.

7. A flute as set forth in claim 3, wherein said embouchure comprises a lip plate extending across said one end of said tube, said lip plate having a downwardly curved portion extending rearwardly of said tube and shaped to rest against the chin and lower lip of a player, said lip plate having a downwardly curved portion extending forwardly of said tube, said lip plate having an opening therethrough into said one end of said tube, said portion of said lip plate extending forwardly of said tube being cut away so that said opening is substantially U-shaped with the upper forward edge of said tube being exposed through said opening.

* * * * *